United States Patent [19]

Schmidt et al.

[11] Patent Number: 4,610,176

[45] Date of Patent: Sep. 9, 1986

[54] METHOD AND APPARATUS FOR ISOLATING WELL PUMP UNITS

[76] Inventors: Ernest A. Schmidt; Donald M. Schmidt, both of R.R. 1, Box 145 B3, Williston, N. Dak. 58801

[21] Appl. No.: 510,941

[22] Filed: Jul. 5, 1983

[51] Int. Cl.[4] ..... H01B 17/00

[52] U.S. Cl. ..... 74/108; 74/581; 174/138 R

[58] Field of Search ..... 74/41, 108, 581, 582, 74/583; 174/138 R, 138 D

[56] References Cited

U.S. PATENT DOCUMENTS

| | | | |
|---|---|---|---|
| 2,574,550 | 11/1951 | Edwards | 174/138 R |
| 3,363,475 | 1/1968 | Foster et al. | 74/581 |
| 3,606,797 | 9/1969 | Browning | 74/41 |
| 4,354,395 | 10/1982 | Page | 74/581 |
| 4,354,397 | 10/1982 | Fix | 74/582 |

*Primary Examiner*—Craig R. Feinberg
*Assistant Examiner*—David A. Okonsky
*Attorney, Agent, or Firm*—Timothy J. Martin

[57] ABSTRACT

The present invention relates to a method and apparatus for electrically isolating the pump unit for a well, such as an oil well and the like. More particularly, the present method and apparatus electrically isolates the pump unit from electrical currents that are generated within a well casing when a fluid is pumped from the well.

20 Claims, 5 Drawing Figures

METHOD AND APPARATUS FOR ISOLATING WELL PUMP UNITS

BACKGROUND OF THE INVENTION

It has, for some time, been recognized that the flow of certain fluids, such as crude oil, through a metal pipeline causes electrical currents to be built up in the pipeline. This electrical charge causes several problems. First, the existence of electrical charge and its subsequent discharge causes accelerated corrosion of the metal pipe such that the useful life of the pipeline is greatly diminished. In fact, in some geographical regions, it has been found that a metal pipe might deteriorate in less than one month's time when a petroleum product is transported through that pipe.

Another problem that is inherent at any time an electrical discharge current exists around a petroleum product is that of the combustion of the fluid or vapors therefrom. This danger of fires and the concomitant damage which the fires or explosions create is understandably of a very serious nature since, at a pump unit, abundant quantities of petroleum products are often present.

One problem, though, that has long plagued the oil field industry has been the degeneration of bearings and gears in the mechanical structure of the pump unit on a typical oil well. As should be appreciated, a typical pump unit has a support structure that forms a fulcrum for a cross beam that supports a counterbalance and a cable mount, and a motor or engine is operated to reciprocate the cable mount up and down. A draw cable is connected to the mount at one end and at the other end is connected to a carrier bar to the polish rod at the well head. This requires numerous gear trains and high tolerance bearing surfaces.

The pump unit reciprocates the cable mount which, in turn, correspondingly reciprocates the polish rod which, through its operation of the well sucker rod, withdraws the fluid from the well. Naturally, since there are great forces involved in pulling the fluid up out of the ground, especially in those areas where oil wells have been drilled several miles into the earth's crust, various bearing surfaces and gears must be of high strength and be very precisely ground.

While it is normally expected that the bearing surfaces and the gears of a well pump unit should have a lifetime of twenty to thirty years, in some regions this lifetime has been observed to be substantially shorter. Indeed, in certain regions along the border between the United States and Canada, it has been found that the bearings and gears of a well pump unit may deteriorate within one or two years. The standard corrective process has been to replace the bearings and gears at frequent intervals, but, until the present time, as explained in this application, no one has recognized the problem that causes this excessive wear and tear on the mechanical structure of the well pump unit.

Specifically, the present inventors have determined that the mechanical failure of gears and bearings within a well pump unit is due to electrical pitting. In the case of bearings, such electrical pitting destroys the smooth bearing surfaces necessary for high tolerance operation. When the surfaces become roughened, the bearings lock or jam, and the pump unit is disabled. This shut down is expensive both since there is lost revenue from the well and since the operative mechanisms of the pump system must be replaced. When gears become pitted, the teeth are weakened so that breakage of the gears may occur. When breakage occurs, small bits of metal become entrained in the gear lubricating fluid so that they continually eat at the turning gears as the device is operated. Over a period of time, similar shut down problems may result.

As noted, prior to the efforts of the present applicants, the problems due to the electrical currents that exist in a well which are present at the well head due to the conductive nature of the well casing had not been solved in a satisfactory manner. As a result of this discovery, by applicants, they recognized a need for a commercially viable method and apparatus that can prolong the useful life of the pump unit's gears and bearings by isolating these electrical currents from the well pump unit. Such a method and apparatus must make use of materials that can withstand the substantial forces that are present when pumping oil or other petroleum products from the ground and which are durable to stand the test of time.

SUMMARY OF THE INVENTION

It is an object of the present invention to provide a method and apparatus for effectively isolating a pump unit from electrical currents that are generated at a well head.

Another object of the present invention is to provide a method and apparatus for electrically isolating a pump unit draw cable from a well polish rod so that electrical discharge currents are prohibited from being introduced into the gears and the bearing mechanisms of the pump unit.

It is yet another object of the present invention to provide a method and apparatus for electrically isolating a pump unit from a well by means of a substance that can withstand extreme compression pressures while at the same time is extremely durable over a long period of time.

It is a further object of the present invention to provide a novel and useful method and apparatus for electrically isolating a pump unit from a well head wherein the method and apparatus is both inexpensive in cost and easily capable of retrofit on an existing pump unit.

To accomplish these objects, the present invention includes a method and apparatus for electrically isolating a well pump unit from the well head by means of a split carrier bar that includes an insulating material which electrically isolates the draw cable of the pump unit from the polish rod at the well head. More particularly, the method according to the preferred embodiment of the present invention provides a carrier bar that is split into two bar segments having opposed cable bores which are adapted to receive the draw cable of the pump unit and complimentary and opposed rod bores which are adapted to receive the polish rod. The method then contemplates the step of electrically isolating the polish rod from the draw cable by positioning an insulating material between the two bar segments to prohibit contact of the bar segments during the pumping operation and positioning insulating material in the cable bores and the rod bores in such a manner whereby the draw cable and polish rod are prevented from contacting the bar segments. Finally, the draw cable and the polish rod are mounted within the insulating material in their respective bores so that the polish rod may be reciprocated by means of operation by the pump unit on the draw cable.

From this method, it should be appreciated that the apparatus according to the present invention contemplates a novel and non-obvious carrier bar formed of a first carrier bar segment having at least one first cable bore and a first rod bore which respectively receive the draw cable and the polish rod. A second carrier bar segment is oriented in spaced apart relation to the first carrier bar segment and is also provided with a at least one second cable bore and a second rod bore for receiving, respectively, the draw cable and the polish rod. An insulator is positioned between the first and second bar segments and in the cable bores and the rod bores. This insulator isolates the bar segments from one another and keeps them in spaced-apart relation to one another. Further, this insulator, by extending into the cable bores and the rod bores around the polish rod and the draw cable, electrically isolates the draw cable, the polish rod, and the bar segments from one another. In the preferred form of this invention, the insulator is in the form of a wafer that is mountable between the bar segments and includes tubular extensions which extend into the respective cable bores and rod bores so that the insulator forms a unitary structure that is sandwiched between the two bar segments. In both the method and apparatus according to the preferred embodiment of the present invention, the insulator is constructed of a material that has a high compression strength that can withstand compression pressures of at least 200 pounds per square inch, and often in the range of 200 pounds per square inch without breaking or wearing out.

These and other objects, advantages, and features of the present invention will become more readily appreciated and understood when taken together with the following detailed description in conjunction with the accompanying drawings, in which:

DETAILED DESCRIPTION OF THE PREFERRED EMBODIMENT

The present invention relates to a method and apparatus for extending the life of the bearings and gears present in the mechanism of a well pump unit by electrically isolating the pump unit from the well itself.

The inventors of the present method and apparatus have discovered that various mechanical components, primarily the bearings and gears that are present in the mechanical system of a well pump unit may undergo deterioration as a direct result of electrical current generated by the pumping of a fluid from a well. This is especially the case for oil wells wherein it has been observed that gears and bearings may wear out in one-tenth or less of their normally expected life.

While this problem has been observed in a fairly wide-spread area, there is a certain geographical dependence upon the rate of deterioration since, in some regions, the deterioration takes place faster than in other regions. However, no one has ever identified the cause of this deterioration prior to the present inventors. This lack of identification of the cause of this deleterious situation has remained despite the fact that it has been known that there are electrical currents which are generated as a result of the movement of oil in a pipeline. This existence of electrical discharge at a pump unit also creates a danger of fires or explosions where petroleum products are present.

Figure 1:
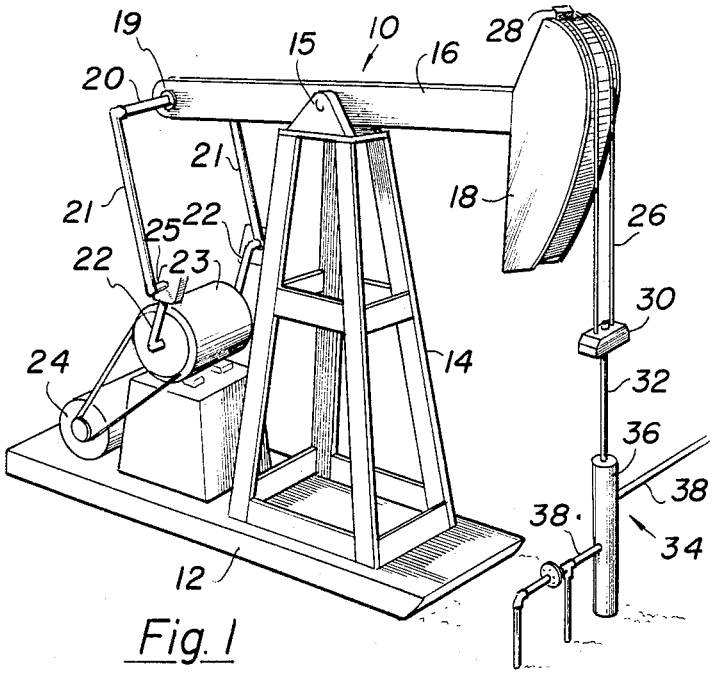
FIG. 1 is a perspective view of a well unit including the carrier bar according to the preferred embodiment of the present invention.

Accordingly, the preferred method and apparatus of the present invention contemplates the electrical isolation of a pump well unit from the well and outlet piping wherein electrical currents may be generated. As shown in FIG. 1, a typical oil pump unit 10 includes a base 12 which mounts an upright support 14 that acts as a fulcrum for cross beam 16 mounted on a pivot 15. Cross beam 16 pivots on support 14 and has, at one end, a cable mount 18 and, at the other end, a tail bearing 19. A cross rod 20 is rotatably journaled in tail bearing 19 and, at its outer ends, rotatably mounts a pair of pitman arms 21 which are connected to crank arm 22. Crank arm 22 is driven by motor 24 through reduction gear box 23 and supports a pair of counterweights 25. Cable mount 18 mounts a drive cable 26 by means of a cable attachment post 28. Cables 26 is connected to a carrier bar 30 which is also attached to polish rod 32 that extends into the oil well.

More particularly, an oil well is provided, at its upper terminal end, with an assembly of valves and piping 34 which is called, in the trade, the "Christmas Tree". Assembly 34 is mounted to the well casing that extends into the ground for the depth of the well. Assembly 34 terminates in a packing 36 opposite this connection to the well casing, and polish rod 32 extends through this packing 36 where it is attached to the well sucker rod (not shown). This sucker rod extends down into the well so that it may be reciprocated to draw fluid upwardly through the well tubing. Polish rod 32 is typically constructed of stainless steel and has a highly polished exterior surface so that it may slide through packing 36 with a close fit so that substantial seal is always maintained between polish rod 32 and packing 36. Assembly 34 includes one or more outlet pipes, such as outlet pipes 38 which are provided with appropriate valves to allow removal of the pumped fluid as it reaches assembly 34.

From the foregoing, it should be appreciated that pump unit 10 includes a number of support axles and pivot points that are provided with bearings (not shown), and the motor drive train and reduction gearbox of pump unit 10 includes various gears and bearings which are fairly standard. While these gears and bearings do not form part of the present invention, it is the purpose of the present invention to protect the various gears and bearings located on pump unit 10 from the deleterious effects of electrical currents that are generated and that are thus present in assembly 34 by the pumping of oil out of the well casing.

The protection according to the preferred embodiment of the present invention is provided by the method of electrically isolating the pump unit 10 from assembly 34 by means of a novel and non-obvious carrier bar 30 which is shown, in greater detail, in FIGS. 2–5. As is seen in these figures, carrier bar 30 is formed by first and second bar segments 40 and 42 that are preferably constructed of steel as is known in the art. Bar segment 40 has an upper face 44, a lower face 46, a pair of side faces such as face 49, and a pair of divergent end faces 48. A pair of first cable bores 50 extend transversely through first bar segment 40 and are perpendicular to the plane of flat face 46 at opposite ends of bar segment 40. Each cable bore 50 intersects a respective end face 48. A first rod bore 52 is centrally located on face 44 and extends through bar segment 40 also perpendicularly to face 46.

Bar segment 42 is complimentary to bar segment 40, and includes an upper face 54 and a lower face 56 that is parallel to upper face 54. A pair of flat, parallel end faces 58 and parallel side faces such as face 59 are provided so that bar segment 42 is generally in the form of a rectangular prism. A pair of second cable bores 60 and a second rod bore 62 extend transversely through bar segment 42 so that they are perpendicular to faces 54 and 56. Bores 60 compliment bores 50, and bore 62 compliments bore 52.

Figure 5:
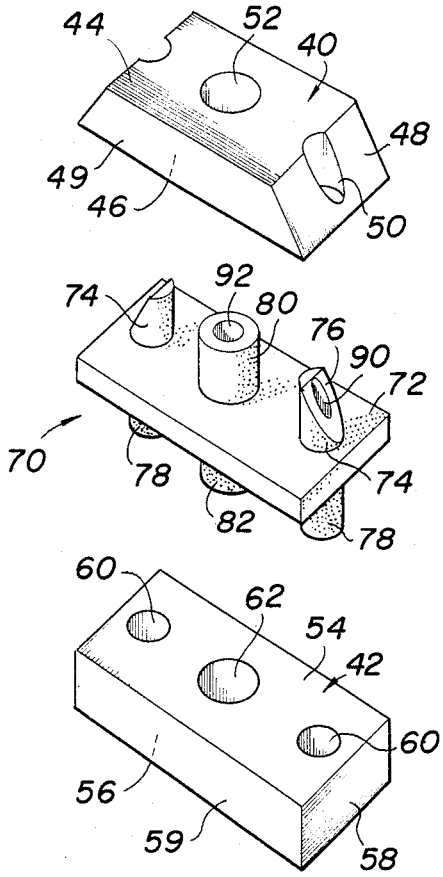
FIG. 5 is an exploded view in perspective of the carrier bar apparatus according to the preferred embodiment of the present invention.

An insulator 70 is constructed to be sandwiched between bar segments 40 and 42, and, as is best shown in FIG. 5. Insulator 70 includes a generally flat, plate like central portion or wafer 72 which is provided with first tubular extensions 74 that are oriented perpendicularly to wafer 72 and are positioned to extend into first cable bores 50. To this end, tubular extensions 74 terminate in slanted faces 76 so that they terminate in a flush manner with slanted end faces 48 of bar segment 40.

A second pair of tubular extensions 78 are oriented perpendicularly to the plane of wafer 72 on a side opposite extensions 74. Tubular extensions 78 are sized to be received by second cable bores 60 in bar segment 42 and have a common axis with a respective tubular extension 74. A tubular extension 80 is perpendicularly mounted on wafer 72, at a central portion thereof, and is positioned to extend into first rod bore 52 of bar segment 40. A corresponding tubular extension 82 is perpendicularly mounted to wafer 72 on a side opposite extension 80 and has a common axis with tubular extension 80. Tubular extension 82 thus extends into rod bore 62 when bar segments 40 and 42 are mounted together. Extensions 80 and 82 are equidistantly spaced between their respective tubular extensions 74 and 78.

Figure 3:
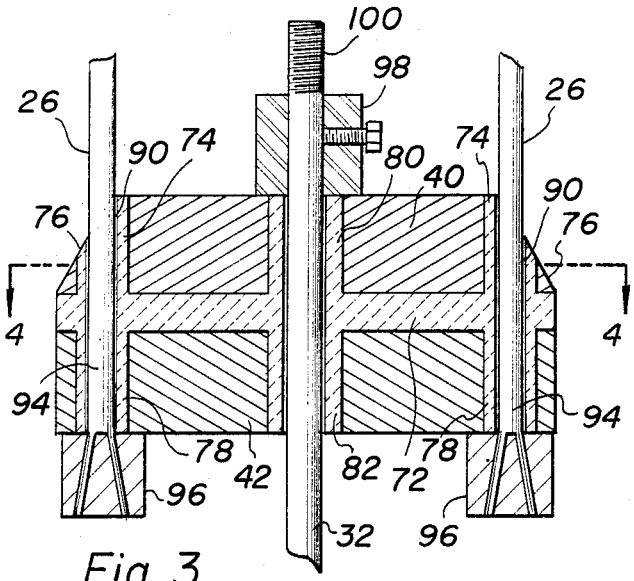
FIG. 3 is a cross-sectional view of the carrier bar apparatus shown in FIG. 2.
Figure 2:
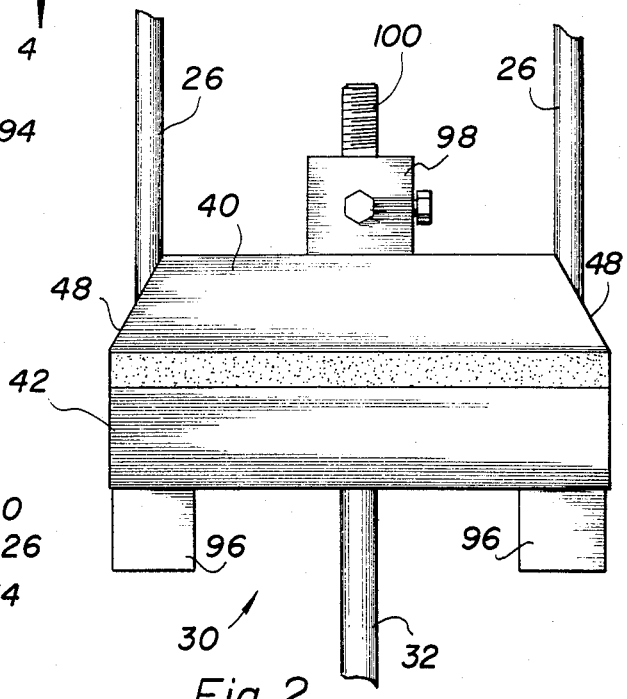
FIG. 2 is a front view in elevation of the carrier bar apparatus according to the preferred embodiment of the present invention.
Figure 4:
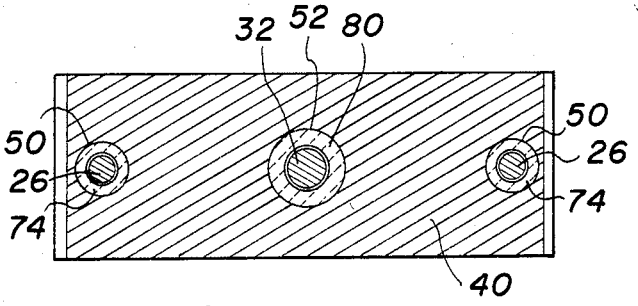
FIG. 4 is a cross-sectional view taken about lines 4—4 of FIG. 3.

As noted above, insulator 70 is adapted to be sandwiched between bar segments 40 and 42, and is constructed of any suitable insulation material. In the preferred embodiment of the present invention, insulator 70 is constructed of an epoxy grout such as that known under the tradename Escoweld 7505 which is sold by Exxon Corporation. As is shown in FIGS. 2 and 3, insulator 70 is sandwiched between faces 46 and 54 of bar segments 40 and 42, respectively, so that wafer 72 maintains bar segments 40 and 42 in spaced apart, parallel relation. When insulator 70 is mated with bar segments 40 and 42, tubular extensions 74 are telescoped within first cable bores 50, tubular extensions 78 are telescoped in second cable bores 60, and tubular extensions 80 and 82 are respectively telescoped into rod bores 52 and 62. Thus, it should be appreciated that cable bores 50 and 60 are complimentary to one another, while rod bores 52 and 62 are complimentary to one another when bar segments 40 and 42 are mounted together to form carrier bar 30.

Complimentary tubular extensions 74 and 78 have a common, axial bore 90 which extends completely through carrier bar 30. Complimentary tubular extensions 80 and 82 have a common axial bore 92 also extending completely through carrier bar 30. Bores 90 are adapted to receive the free ends 94 of drive cable 26 so that the insulating material forming tubular extensions 74 and 78 completely surround the portion of draw cable 26 that lies within carrier bar 30. As is shown in FIG. 3, a locking bracket 96 may be secured to free ends 94 of draw cable 26 to prevent removal of cable 26 from carrier bar 30.

Polish rod 32 may be mounted to extend through bore 92 and in tubular extensions 80 and 82 so that the insulating material forming tubular extensions 80 and 82 completely surrounds the portion of polish rod 32 that extends through carrier bar 30. It should be appreciated that polish rod 32 extends in the direction through carrier bar 30 that is opposite the direction which draw cable 26 extends through carrier bar 30 and that it is secured by a locking bracket 98 on the side of carrier bar 30 that is opposite locking brackets 96. Once locking bracket 98 is secured to the free end 100 of polish rod 32, polish rod 32 may not be withdrawn from carrier bar 30.

Based on the foregoing, it should now be appreciated that the method according to the preferred embodiment of the present invention contemplates increasing of the useful life of gears and bearings found in a well pump station assembly that has a polish rod and a draw cable. This method combines the elimination of the electrical pitting of the bearings, gears and the like. To accomplish this method, a carrier bar is provided which is operative to interconnect the draw cable and the polish rod wherein the carrier bar is split into first and second bar segments, such as bar segments 40 and 42, with these bar segments having complimentary and opposed cable bores adapted to receive the draw cable and which have complimentary and opposed rod bores to receive the polish rod. The method then electrically isolates the polish rod from the draw cable and the bar segments from one another by positioning insulating material between the two bar segments to prohibit contact thereof and by positioning material in the cable bores and in the rod bores in such an orientation whereby the draw cable is prevented from contacting the bar segments and the polish rod is prevented from contacting the bar segments when they are mounted within the carrier bar. Further, in the preferred method, insulating material is selected to have a high compression strength capable of withstanding compression pressures of at least 200 pounds per square inch, although it is desirable for the material to be capable of withstanding 200 pounds per square inch. Further, it is preferred to electrically isolate the first and second bar segments, and therefore the polish rod and draw cable in such manner that the bar segments are in parallel, spaced-apart relation, separated by insulating material having a substantially uniform thickness, and, where the insulating material in the cable and rod bores is formed as unitary tubular extensions of the wafer.

As noted above, it is preferred to use an epoxy grout material to form the insulating material that comprises insulator 70. The advantage of an expoxy grout is that it can withstand compression pressures of at least 200 pounds per square inch which approximates the pressures often existing on a carrier bar. Specifically, polish rod 32 undergoes tension of approximately 10,000–60,000 lbs. during the pumping operation so that it is necessary to provide a material that will not break down under these pressures. A further advantage in using an epoxy grout lies in the fact that the epoxy grout has adhering properties so that, when used with bar segments 40 and 42, the epoxy grout binds carrier bar segments 40 and 42 together to prevent separation when the device is not in operation. It should be appreciated, however, that no adherence or clamps are necessary in this invention since the bar segments are compressed together by the pressure head of the well operating on polish rod 32 and the tension of draw cable 26.

While epoxy grout is the selected material according to the preferred embodiment of the present invention, it should be appreciated that other insulating materials are totally within the scope of this invention. Numerous insulators could be used where those insulators exhibit a compression strength of at least 200 pounds square inch. Examples of other insulators may include some rubber belting materials, asbestos sheets, Nylatron, fiberglass, plastics, and composite insulation materials.

Embodiments of the present invention have been shown and described with a degree of particularity to enable a complete and full understanding of those embodiments. It should be understood, however, that the present invention involves inventive concepts defined in the appended claims, and these inventive concepts are not intended to be limited by the detailed description herein beyond that required by the prior art and as the claims are allowed. The Method and Apparatus for Isolating Well Pump Units of the present invention can take other forms and is susceptible to various changes in detail of structure without departing from the principles of this invention.

We claim:

1. In a well pump unit wherein a well is provided with a polish rod and the pump unit includes at least one draw cable adapted to reciprocate said polish rod, a method for increasing the life of mechanical parts of the pump unit by eliminating electrical pitting in said pump unit, comprising the steps of:

providing a carrier bar operative to interconnect the at least one draw cable and the polish rod wherein said carrier bar is split into first and second bar segments, each of said first and second bar segments having similarly dimensioned facing surface and complimentary and opposed cable bores adapted to receive said draw cable and having complimentary and opposed rod bores adapted to receive said polish rod;

electrically isolating said polish rod from said draw cable by positioning first insulating material between said first and second bar segments completely across the area between said facing surfaces to prohibit electrical contact therebetween and by positioning second insulating material in said cable bores and said rod bores in such orientation whereby said draw cable is prevented from contacting said first and second bar segments, said polish rod is prevented from contacting said first and second bar segments; and mounting said draw cable and said polish rod to said carrier bar whereby the force exerted on the carrier bar by said draw cable and polish rod is uniformly distributed across the first insulating material between the bar segments.

2. The method according to claim 1 wherein the step of electrically isolating the polish rod and the draw cable is accomplished by separating said first and second bar segments in parallel spaced-apart relation by a wafer of insulating material having a substantially uniform thickness, the insulating material in the cable bores and the rod bores being formed as tubular extensions formed of said wafer formed integrally therewith.

3. The method according to claim 1 wherein said insulating material is composed of a high compression strength material capable of withstanding compression pressures of at least 200 pounds per square inch.

4. The method according to claim 3 wherein said insulating material is an epoxy grout.

5. The method according to claim 3 wherein said insulating material is selected from the group consisting of asbestos, fiberglass rubber, plastic, and insulating composites.

6. In a well pump unit wherein a well is provided with a polish rod and the pump unit includes a cross beam, at least one cable mount, and at least one draw cable secured at a first end thereto, the improvement comprising a carrier bar interconnecting a second end of said draw cable and said polish rod whereby movement of said draw cable reciprocates the polish rod, said carrier bar defined by a pair of bar segments having similarly dimensioned spaced-apart facing surfaces, each of said bar segments having complimentary cable bores adapted to receive said draw cable so that the draw cable extends through said carrier bar and complimentary rod bores adapted to receive said polish rod so that the polish rod extends through said carrier bar, and further defined by a layer of electrical insulation material positioned substantially throughout the volume between said facing surfaces and around said polish rod and draw cable in said rod bores and cable bores, respectively, whereby said bar segments are electrically insulated from one another and said draw cable is electrically insulated from said polish rod.

7. The improvement of claim 6 wherein said insulation material is defined by a flat wafer of material between said bar segments and including tubular portions integrally formed with said wafer and extending into said cable bores and rod bores around said draw cable and said polish rod, respectively to define at least first and second pairs of tubular extensions, the tubular extension of each pair being aligned with one another and projecting away from said flat wafer on opposite sides thereof.

8. The improvement of claim 6 wherein said insulation material has a compression strength capable of sustaining pressures of at least 200 pounds per square inch.

9. The improvement of claim 8 wherein said insulation material is substantially non-deformable.

10. The improvement of claim 9 wherein said insulation material is an epoxy grout material.

11. The according to claim 9 wherein said insulating material is selected from the group consisting of asbestos, fiberglass, rubber, plastic, and insulating composites.

12. A carrier bar adapted for use in interconnecting at least one draw cable of a well pump unit and a polish rod of a well and operative to electrically isolate the polish rod from the draw cable, comprising:

a first bar segment having a first surface and a first cable bore and a first rod bore extending therethrough;

a second bar segment having a second surface in spaced apart, facing relation to said first surface and a second cable bore and a second rod bore extending therethrough, said first and second cable bores being coaxial, and said first and second rod bores being coaxial;

first insulation means between said first and second bar segments and substantially filling the region for electrically isolating said first and second bar segments from one another; and second insulation means in said cable bores and said rod bores for electrically isolating said draw cable and said polish rod from one another.

13. A carrier bar according to claim 12 including two pairs of first and second cable bores, said second insulation means in both said pairs of first and second cable bores.

14. A carrier bar according to claim 12 wherein said first insulation means includes a flat wafer of insulating material and said second insulation means includes tubular extensions of said wafer formed integrally therewith and extending into respective ones of said cable bores and said rod bores.

15. A carrier bar according to claim 14, wherein first and second insulation means is constructed of an epoxy grout.

16. A carrier bar according to claim 15, wherein said cable bores and said rod bores are oriented perpendicularly to their respective first and second surfaces, and first and second rod bores positioned equidistant between their respective pairs of cable bores.

17. A carrier bar for use in interconnecting at least one draw cable of a well pump unit and a polish rod of a well and operative to electrically isolate the polish rod from the draw cable, comprising:

a first carrier bar segment having a first face and a first cable bore and a first rod bore therethrough;

a second carrier bar segment having a second face of substantially equivalent dimensions as said first face and in spaced-apart relation with said first face and insulator means substantially filling the region between said first and second faces and in said first and second cable bores and in said first and second rod bores for electrically isolating said bar segments, said draw cable and said polish rod from one another when said draw cable is positioned in said cable bores and said polish rod is positioned in said rod bores.

18. The carrier bar according to claim 17 wherein said first insulation means includes a flat wafer of insulating material and said second insulation means includes tubular extensions of said wafer formed integrally therewith and extending into respective ones of said cable bores and said rod bores.

19. The carrier bar of claim 18 wherein said insulation material has a compression strength capable of sustaining pressures of at least 200 pounds per square inch.

20. The carrier bar according to claim 19 wherein first and second insulation means is constructed of an epoxy grout.

* * * * *